US006388388B1

(12) United States Patent
Weindorf et al.

(10) Patent No.: US 6,388,388 B1
(45) Date of Patent: May 14, 2002

(54) BRIGHTNESS CONTROL SYSTEM AND METHOD FOR A BACKLIGHT DISPLAY DEVICE USING BACKLIGHT EFFICIENCY

(75) Inventors: Paul Fredrick Luther Weindorf, Novi; Gregory John Milne, South Lyons, both of MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/748,913

(22) Filed: Dec. 27, 2000

(51) Int. Cl.[7] ..... H05B 37/02

(52) U.S. Cl. ..... 315/169.3; 315/157; 315/158

(58) Field of Search ..... 315/158, 157, 315/156, 30, 169.3

(56) References Cited

U.S. PATENT DOCUMENTS 6,069,449 A * 5/2000 Murakami ..... 315/158

* cited by examiner

*Primary Examiner*—David Vu
(74) *Attorney, Agent, or Firm*—Brinks Hofer Gilson & Lione; Richard K. Clark

(57) ABSTRACT

The invention provides a brightness control system for a backlight display device that uses the efficiency of the backlight to control the backlight to a desired brightness or luminance. The backlight display device may have a display panel, a backlight, a temperature measurement device, and control circuitry. The control circuitry provides a drive current to the backlight in response to a backlight efficiency and a desired brightness signal. The backlight efficiency is a function of the backlight temperature. The brightness control system may maintain the desired brightness throughout the dynamic range of the backlight display device.

36 Claims, 6 Drawing Sheets

Note 1: This Time May Be Minimized For More Stable Display Digital Signals (DCLK, VSYNC, HSYNC, etc.)

BRIGHTNESS CONTROL SYSTEM AND METHOD FOR A BACKLIGHT DISPLAY DEVICE USING BACKLIGHT EFFICIENCY

FIELD OF THE INVENTION

This invention generally relates to control systems for display devices. More particularly, this invention relates to brightness control systems for backlight display devices.

BACKGROUND OF THE INVENTION

Backlight display devices are used in a variety of consumer and industrial products to display data, charts, graphs, messages, other images, information, and the like. Backlight display devices, which may be backlit or frontlit, have a backlight positioned to provide light for a display panel. The backlight may be a fluorescent tube, an electroluminescent device, a gaseous discharge lamp, a plasma panel, and the like. The display panel display may be a passive or active matrix liquid crystal display (LCD). The backlight and display panel are connected to control circuitry, which is connected to a voltage supply. Alternatively, the display may be emissive such as an organic LED display which does not have a backlight. The display device may be separate or incorporated with other components, such as a dashboard in an automobile or other vehicle, a portable electronic device, and the like.

In general, the luminance of the backlight is adjusted to provide the desired brightness of the backlight display device. A driver circuit controls the backlight luminance by increasing or decreasing the drive current to the backlight. The drive current typically is adjusted in relation to the environment and user preferences. A poorly-lit environment usually requires less brightness, and thus a lower drive current, than a brightly-lit environment. Different users may have different desired brightness levels. The brightness may be changed automatically or manually. The backlight display device may have a switch, a keypad, a touch screen, a remote device, or the like to adjust the brightness. The backlight display device may have an automatic brightness control system, which also may include manual adjustments to brightness.

The backlight luminance is proportionate to the drive current. However, the efficiency of the backlight may change during operation of the backlight display device. The changing efficiency varies the backlight luminance and hence the brightness of the backlight display device. The efficiency of the backlight display device usually is low at start-up and then increases during a "warm-up" period. The efficiency may or may not be proportional to temperature. The efficiency during start-up may be very low, thus providing a dim or no image until the warm-up period is completed. To reduce the warm-up period, some backlights have resistive wire wrapped around the backlight or other backlight heater techniques. Some backlights are designed to quickly self-heat. Even after the warm-up period, the efficiency of the backlight may change during operation of the backlight display device, such as when the backlight display device moves through colder and warmer ambient conditions. The backlight efficiency may change due to the drive current level itself. Higher drive currents tend to increase the backlight temperature and lower drive currents tend to decrease the backlight temperature, thus changing the efficiency. The backlight efficiency also may change for other reasons such as little or no lumen maintenance over time and variations in thermal resistance and circuit operation. Unless the drive current is adjusted for changes in the efficiency of the backlight, the brightness of the backlight display device may vary during operation. A user also may adjust or readjust the brightness in response to the changing brightness.

Many backlight display devices adjust the drive current level based on the temperature of the backlight. A temperature sensor senses the temperature of the backlight. The temperature is compared to a look-up table of drive current levels for the backlight display device. The look-up table provides drive current levels ($V_o$) as a function of temperature (T) for each brightness level in the dynamic range. For each brightness level, an entire series of $V_o$ vs. T data values is required. Based on the temperature and brightness level, a drive current level is selected for the backlight display device. This approach may lead to very large look-up tables. Each brightness level needs a large number of $V_o$ vs. T data values to properly control the luminance of the backlight. Additional $V_o$ vs. T data values may be necessary to give a more gradual appearance to changes in the drive current level at a constant desired brightness. Other factors may increase the number of brightness levels.

More brightness levels may be needed in applications having wider dynamic ranges and variable resolution of the brightness. A wider dynamic range generally needs more brightness levels than a narrower dynamic rage. The dynamic range corresponds to the use of the display device. A narrow dynamic range may cover one or a small number of uses such as daylight use, nighttime use, or the like. A wide dynamic range may cover several uses such as daylight use, nighttime use, dusk-to-dawn use, and the like.

The number of brightness levels also increases when the desired brightness resolution increases. More brightness levels provide higher resolution than fewer brightness levels with sufficient resolution. Brightness adjustments generally need to have variable resolution because of how the human eye perceives changes in brightness. The human system perceives changes in brightness non-linearly and logarithmically. A user perceives a brightness change from about 10 nits to about 12 nits as essentially equal to a brightness change from about 100 nits to about 120 nits. As the brightness level decreases, more brightness resolution provides brightness step changes perceived as uniform by a user. Thus, a backlight needs more brightness resolution at lower luminance levels and less brightness resolution at higher luminance levels.

The look-up table usually is provided in a memory or other data storage device in the backlight display device. As more brightness levels are required, a larger memory device is needed. The look-up tables also may be more difficult to implement in a brightness control system and may delay changes to the luminance level backlight device. This approach may be essentially unworkable or expensive for daytime automatic brightness functions that may require greater than about 160 brightness levels to control the display brightness as a function of ambient light.

SUMMARY

This invention provides a brightness control system for a backlight display device that uses the efficiency of the backlight to calculate and control the backlight to a desired brightness or luminance for the backlight display device. The backlight efficiency is a function of the backlight temperature. At each backlight temperature, the brightness is linearly proportional to the drive current for the backlight. By using the backlight temperature and backlight efficiency to control the backlight to the desired brightness, the brightness control system may maintain the desired brightness throughout the dynamic range of the backlight display device.

In one aspect, the backlight display device has a display panel, a backlight, a temperature measurement device, and control circuitry. The backlight is positioned next to the display panel. The temperature measurement device is operatively positioned near the backlight. The control circuitry is connected to receive a temperature signal from the temperature measurement device. The control circuitry is connected to provide a drive current to the backlight. The control circuitry determines a backlight efficiency in response to the temperature signal. The control circuitry determines the drive current in response to the backlight efficiency and a desired brightness signal.

In a method for controlling the brightness of a backlight display device, a desired brightness signal is provided for a backlight. A temperature signal is generated that is indicative of the temperature of the backlight. A backlight efficiency is determined in response to the temperature signal. A drive current is provided to the backlight in response to the backlight efficiency and the desired brightness signal.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

BRIEF DESCRIPTION OF THE FIGURES

The invention may be better understood with reference to the following figures and detailed description. The components in the figures are not necessarily to scale, emphasis being placed upon illustrating the principles of the invention. Moreover, like reference numerals in the figures designate corresponding parts throughout the different views.

DETAILED DESCRIPTION OF THE PREFERRED EMBODIMENTS

Figure 2:
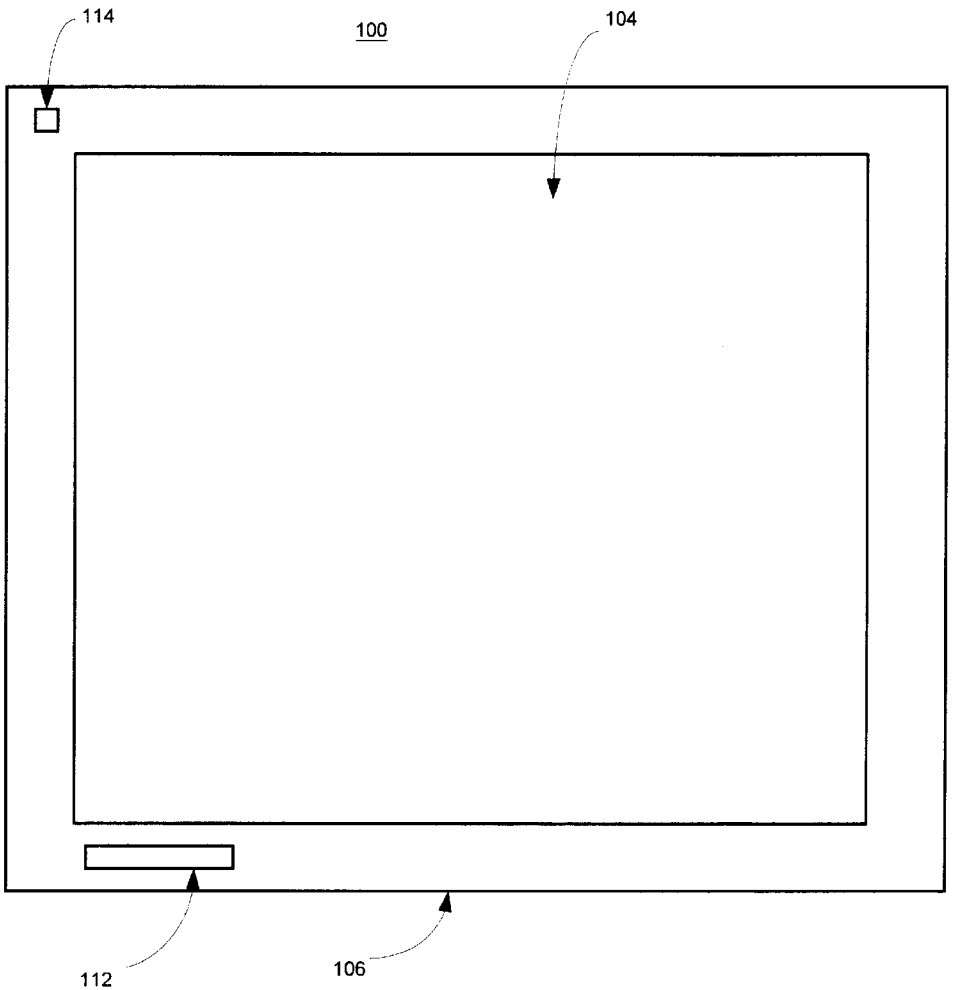
FIG. 2 is a representative front view of the backlight display device shown in FIG. 1.
Figure 1:
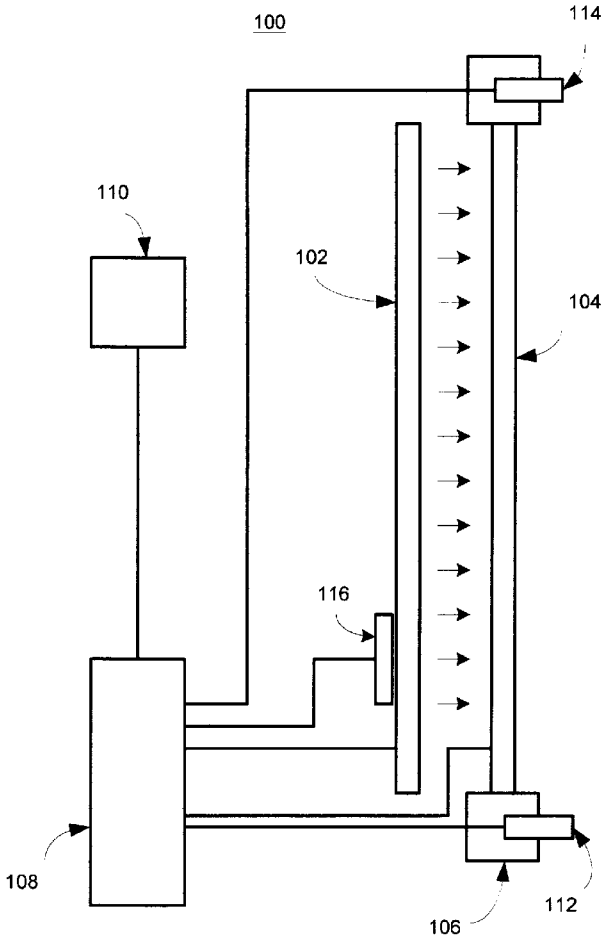
FIG. 1 is a representative side view of a backlight display device having a brightness control system according to one embodiment.

FIGS. 1 and 2 represent block diagrams of a backlight display device 100 having a brightness control system according to one embodiment. FIG. 1 shows a side view of the backlight display device 100. FIG. 2 shows a front view of the backlight display device 100. In this embodiment, the backlight display device 100 includes a backlight 102, a display panel 104, a bezel 106, control circuitry 108, a voltage supply 110, a user interface 112, a logarithmic sensor 114, and a temperature sensor 116. The backlight display device 100 may have different, additional or fewer components and different configurations.

The backlight display device 100 may provide a reverse image for rear projection, may project an image onto a display surface (not shown), may have one or more magnification lens (not shown) and reflective surfaces (not shown), may work with or have other components, and the like. The backlight display device 100 may be incorporated in a navigation radio system for an automobile or other vehicle. The backlight display device 100 may be built-in or integrated with a dashboard, control panel, or other part of an automobile or other vehicle. The backlight display device 100 also may be built-in or integrated with an electronic device, such as a laptop computer, personal organizer, and the like. Additionally, the backlight display device 100 may be separate or a separable component. While configurations and modes of operation are described, other configurations and modes of operation may be used.

In one aspect, the backlight 102 and the display panel 104 form a liquid crystal display (LCD). The backlight 102 may be operatively disposed to provide light for operation of the display panel 104. The backlight 102 and the display panel 104 may be a passive or active matrix LCD and may comprise another type of backlit or frontlit lighted display. The backlight 102 and the display panel 104 may provide monochrome, color, or a combination of monochrome and color. In this aspect, the backlight 102 is a cold cathode fluorescent lamp. The backlight 102 may be one or more aligned fluorescent tubes, electroluminescent devices, gaseous discharge lamps, light emitting diode (LED), organic LEDs, plasma panels, a combination thereof, and the like. The backlight 102 may include multiple or sub backlights. The backlight 102 also may include an inverter (not shown) and other circuitry. The display panel 104 may be selected based on the type of backlight and may have multiple or sub display panels.

In this embodiment, the bezel 106 extends around and holds the outer perimeter of the display panel 104. The bezel 106 may have various configurations and may extend around part or only a portion of the outer perimeter. The bezel 106 may hold or extend around other components such as the backlight 102. The bezel 106 may include additional bezels and may be connected with or part of another component, such as a dashboard in an automobile.

The control circuitry 108 is connected to provide an image signal to the backlight 102 and the display panel 104. The control circuitry 108 may include one or more microprocessors and may be part of or incorporated with other circuitry, such as a central processing unit or a vehicle control unit. The control circuitry 108 may be completely or partially provided on one or more integrated circuit (IC) chips. The control circuitry 108 may have other circuitry for control and operation of the backlight display device 100, such as a transceiver, one or more memory devices, analog components, and the like. The control circuitry 108 also is connected to a voltage supply 110, which may be provided by an automotive battery or electrical system, another type of battery, a household current supply, or other suitable power source.

Along with other operating parameters and signals, the control circuitry 108 controls or adjusts the luminance of the backlight and consequently the luminance of the display panel 104. In one aspect, the control circuitry 108 provides a brightness command signal to the backlight or similar signal that corresponds to a luminance or brightness value for the desired or selected brightness of the display panel 104. The commanded brightness signal changes the brightness.

The control circuitry 108 may generate the image signal and may pass the image signal from another source (not shown). The image signal may be based upon one or more radio signals, one or more signals from a global positioning system (GPS), data stored in a memory device, user inputted data, a combination, and the like.

The user interface 112 enables a user to adjust various aspects of the display including contrast, brightness, color, and the like. In one aspect, the user interface 112 is disposed in or on the outer surface of the bezel 106. In this aspect, the user interface 112 is one or more knobs or push buttons, a touch screen, a voice activated system, or other means for user selection. The user interface may comprise other types of manual controls, electronic input from another device, and the like. The user interface 112 may be located elsewhere, may be incorporated with another controller or user interface, and may be included in a remote control device.

The logarithmic sensor 114 is connected to the control circuitry 108 and is disposed to provide a signal indicative of the ambient light on or near the display panel 104. In one aspect, the logarithmic sensor 114 includes a photodiode (not shown) connected to a logarithmic amplifier (not shown). The logarithmic sensor 114 may have other components and configurations.

The temperature sensor 116 is connected to the control circuitry 108 and is operatively disposed near the backlight 102. The temperature sensor 116 may be any temperature measurement device suitable for measuring the temperature of the backlight 102 and suitable for operating under environmental conditions of the backlight display device 100. "Operatively disposed near the backlight 102" includes any location or position where the temperature sensor 116 may provide a signal indicative of the temperature of the light source in the backlight 102. In one aspect, the temperature sensor 116 is a thermistor or other temperature sensitive resistor attached directly to the backlight 102. The temperature sensor 116 may be bimetallic, ceramic, another material, or combination of materials having one or more electrical properties corresponding and changing in relation to the temperature of the backlight 102. In other embodiments, an infrared temperature sensor is used.

The brightness control system uses the efficiency of the backlight 102 to calculate and control the backlight 102 to the desired brightness or luminance of the backlight display device 100. As discussed below, the backlight efficiency is a function of the backlight temperature. At each backlight temperature, the brightness is linearly proportional to the drive current or power for the backlight. By using the backlight temperature and backlight efficiency to control the backlight to the desired brightness, the brightness control system may maintain the desired brightness throughout the dynamic range of the backlight display device 100. The dynamic range may encompass various ambient conditions, including the temperature range, encountered in the automobile environment.

Figure 3:
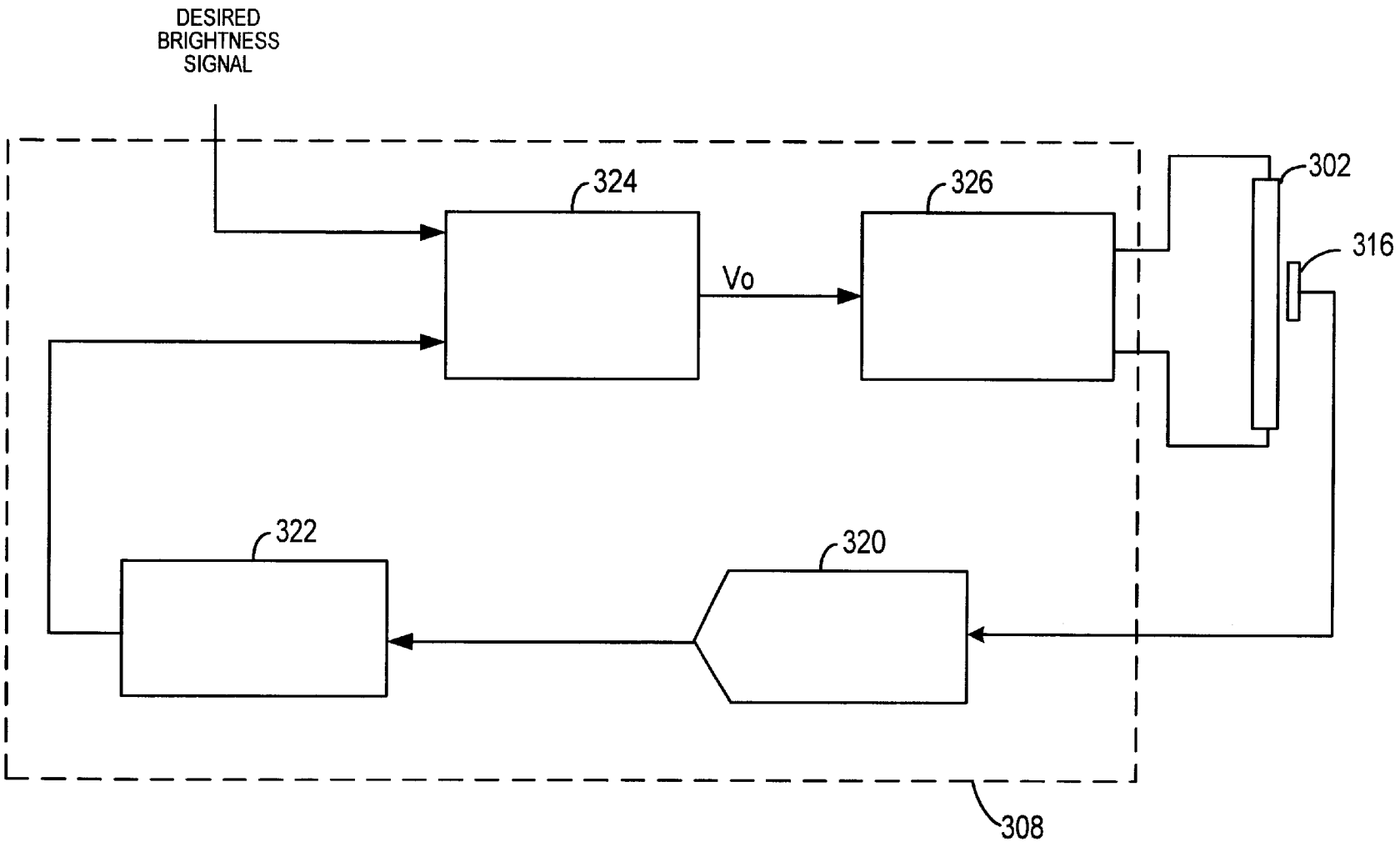
FIG. 3 is a representative block diagram and flowchart of a brightness control system for a backlight display device according to one embodiment.

FIG. 3 represents a block diagram and flowchart of a brightness control system for a backlight display device according to one embodiment. In one aspect, the brightness control system has a backlight 302, a temperature sensor 316, an analog-to-digital converter (ADC) 320, a backlight efficiency calculator 322, a backlight drive calculator (BDC) 324, and a backlight driver 326. The brightness control system may have fewer or additional components.

The temperature sensor 316 is positioned near or on a backlight 302 of a backlight display device (not shown). The temperature sensor 316 may be a temperature measurement device as previously discussed. The temperature sensor 316 generates an analog signal indicative of the temperature of the backlight 302.

The ADC 320 converts the analog signal into a digital temperature signal. The backlight efficiency calculator 322 determines backlight efficiency in response to the digital temperature signal. The backlight drive calculator 324 determines a drive current level ($V_o$) in response to the backlight efficiency and a desired brightness. The desired brightness may be a commanded brightness signal from a manual or automatic brightness control system. The desired brightness may be another signal indicative of the desired brightness for the backlight display device. In one aspect, the BDC 324 determines the drive current level ($V_o$) based on the following equation:

$$V_o = B/E \qquad \text{(Eqn. 1)},$$

where B is the desired brightness and E is the backlight efficiency. The backlight driver 326 provides a drive current ($V_o$) to the backlight 302 in response to the drive current level. Equation 1 may ignore offsets, which may or may not be present.

The brightness control system uses the backlight efficiency, which varies as a function of the backlight temperature, to drive the backlight. The backlight efficiency varies greatly as a function of temperature and may vary from about 4 nits/volt through about 94 nits/volt for the same backlight, where backlight current is directly proportional to the control voltage. The brightness control system may be used to properly maintain the brightness over this wide variation in efficiency. In one aspect, the brightness control system is essentially a feedback loop and may be used to continually update the backlight control voltage ($V_o$) to maintain a desired or commanded brightness.

Plots of brightness versus drive for each temperature of the backlight provide a series of essentially linear curves. The slopes of these curves represent the efficiency of the backlight at each temperature. If the backlight temperature is known, the brightness may be controlled by using the backlight efficiency for that backlight temperature. As the brightness changes, the backlight temperature changes which requires dynamic recomputation of the drive level as a function of the changing efficiency values. In one aspect, the feedback loop is stable because the thermal lag time of the backlight is much slower than the temperature sampling and drive level update cycle time.

An error analysis may minimize the number of efficiency values that need to be included. This analysis may be a function of the quantum error introduced by the temperature, analog to digital converter (ADC), and the span between temperatures. In one aspect, by selecting a brightness error criterion of 7 percent and using an 8-bit ADC for the temperature converter, the numbers of temperatures that need to be included are reduced to 44 values for a backlight temperature range of about −40° C. through about 98° C. Finer temperature resolution may be required where the efficiency slope is greatest. Conversely, less temperature resolution may be required as the efficiency slopes decrease. Interpolation may be used to compute the efficiency between data point values.

In addition, the brightness control system may compute the drive level as a function of the desired brightness and the backlight efficiency. The brightness divided by the efficiency may use a 32-bit floating-point multiplication or division due to the wide dynamic range of the brightness and efficiency values. However, the efficiency and the brightness values may be stored in 8-bit words if a scientific method is used where the 8-bit word is divided into mantissa and exponent values.

Figure 4:
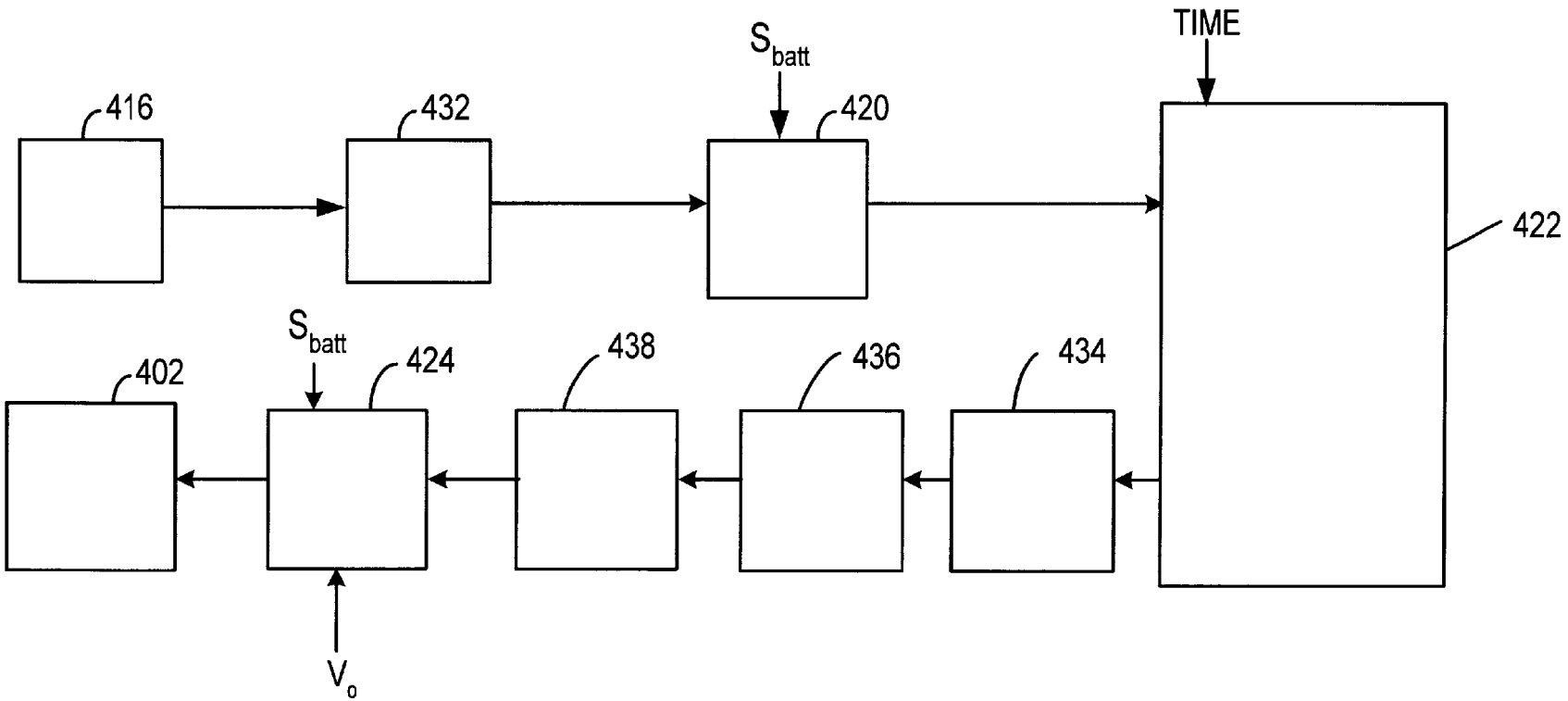
FIG. 4 is a representative block diagram and flowchart of an inverter current control system for a backlight display device according to one embodiment.

FIG. 4 represents a block diagram and flowchart of an inverter current control system for a backlight display device according to one embodiment. In this embodiment, the brightness control system has a thermistor 416, a thermistor linearization corrector 432, an analog to digital converter (ADC) 420, a backlight current control selector 422, a voltage corrector 434, a digital to analog converter (DAC) 436, an over-temperature protector 438, an inverter 424, and a backlight 402. The inverter 424 provides a drive current level to the backlight 402 based on an Sbatt voltage and temperature, and a PWM drive level based on the desired brightness and the backlight efficiency computed from the temperature measurement of the backlight 402 as described below. The brightness control system may have fewer or additional components. The Vo (see FIG. 3) controls the PWM drive level for the inverter while the inverter current level during the PWM on time is controlled as described below.

In this embodiment, the thermistor 416 is a temperature sensitive resistor and is attached directly to the backlight 402. The thermistor 416 may be another temperature measurement device and may be positioned elsewhere as previously discussed. The correlation between the thermistor resistance and backlight temperature may be determined by the following equations:

$$R = 20K \exp\left[4282\left(\frac{1}{(T+273)} - \frac{1}{298}\right)\right] \text{ or} \quad \text{(Eqn. 2)}$$

$$T = \frac{1}{\frac{1}{298} + \left(\frac{1}{4282}\right)\ln\left(\frac{R}{20k}\right)} - 273 \quad \text{(Eqn. 3)}$$

where T is the temperature in ° C. of the backlight and R is the resistance of the thermistor 416.

The linearization corrector 432 may be a circuit or other suitable electrical converter that converts the thermistor resistance into a voltage, which then may be converted to a digital value via the analog to digital converter (ADC) 420. In one aspect, an analog or other circuit that converts the thermistor resistance into voltage may be described by the following equation:

$$V_T = \frac{5\ \mathrm{V}(10K)(18.2K + R)}{(10K)(18.2K) + R(28.2K)} \quad \text{(Eqn. 4)}$$

where $V_T$ is the voltage of the converted resistance and R is the resistance of the thermistor 416.

Figure 5:
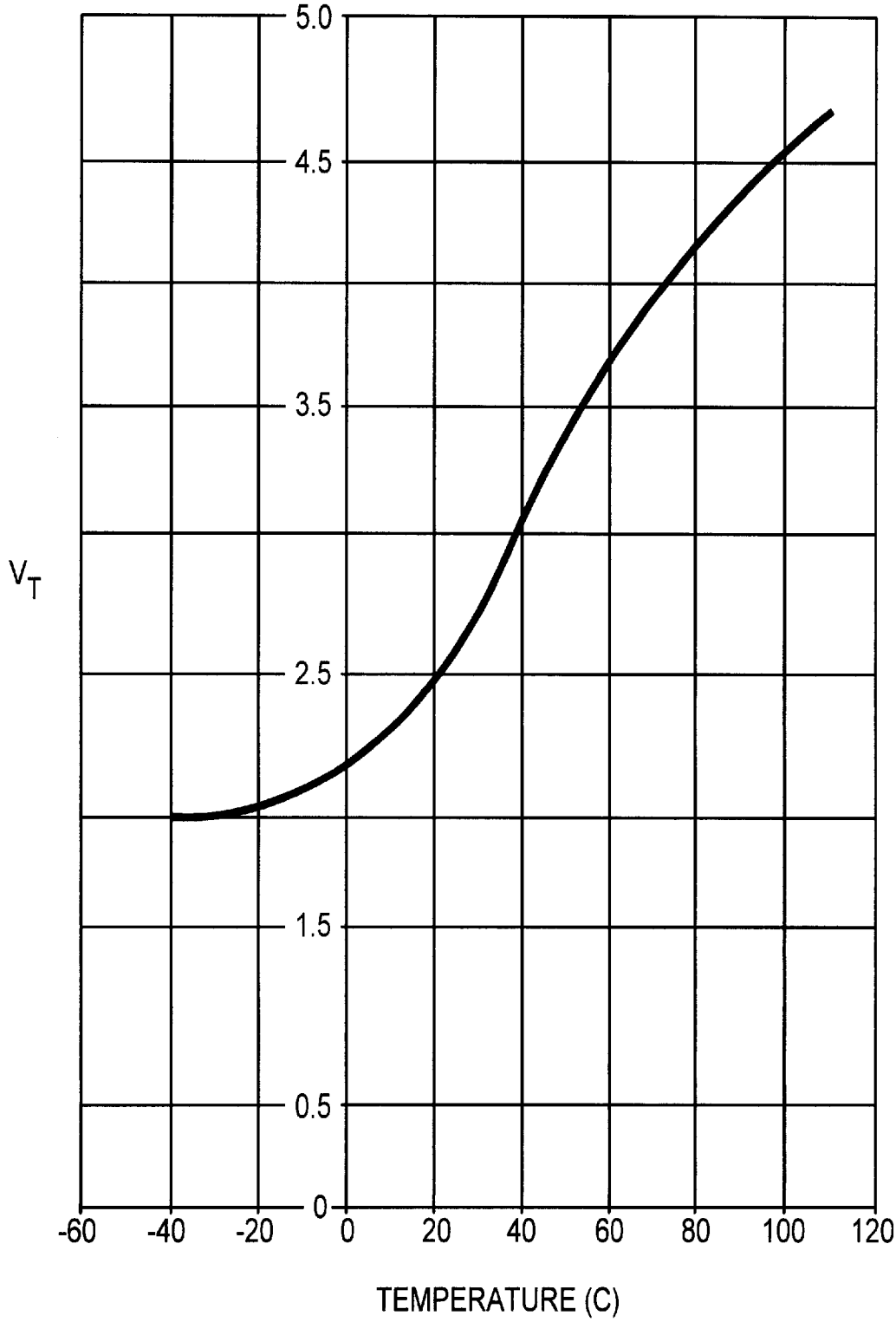
FIG. 5 is a plot of a $V_T$ versus T curve.

Substituting Equation 2 for R in Equation 4 yields a $V_T$ versus T curve as shown in FIG. 5. The output of the linearization corrector 432 is connected to the ADC 420, which may be an 8-bit or other ADC. A switched battery voltage, Sbatt provides a supply voltage to the inverter 424. Sbatt may be voltage divided by a factor of 0.272 or other factor for the input voltage range of the ADC 420. In one aspect, an Sbatt voltage of 14.5V is divided to 3.94V, which becomes an analog to digital count or level of 201 for an 8-bit ADC.

The ADC 420 provides backlight temperature data or a digital temperature signal and the Sbatt voltage to the current control selector 422. The ADC 420 also provides the temperature data to block 322 of FIG. 3. A time input may be provided to the current control selector 422. The time input may be used to determine when to shutdown a "boost" current if one is provided. The boost current may be 9 mA. The time input also may be used to provide a controlled rate of "boost" shutdown. As described below, the current control selector 422 selects the current level supplied to the inverter 424. The voltage corrector 434 corrects the voltage of the current supplied based on the Sbatt value. The inverter current is dependent on the battery voltage. Careful control of the current is desired to maintain backlight life while providing the desired luminance. The DAC 436 converts the digital DAC count into an analog voltage that eventually controls the inverter current level. In one aspect, the DAC 436 is a quad 8-bit DAC. The DAC output voltage may be calculated by the following equation:

$$V_{DAC} = \frac{(DAC_{count} \cdot 3.3\ \mathrm{V})}{255} \quad \text{(Eqn. 5)}$$

where $V_{DAC}$ is the output voltage and $DAC_{count}$ is the count of the DAC.

The brightness control system may have a backlight over-temperature protector 438, which limits the backlight current to about 10 mA when the backlight temperature is below the range of about 45° C. through about 70° C. When the backlight temperature rises above the range of about 45° C. through about 70° C., the backlight current is reduced to about 6 mA. The over-temperature protector 438 protects both the display and inverter from overheating. When the current is not limited (i.e. is lower than the maximum), other multiplier and constant values may be used. The transfer function from the DAC to the Inverter input may be defined by the following equation:

$$V_{IBrite} = (0.49 \cdot V_{DAC}) + 0.1238 \quad \text{(Eqn. 6).}$$

When the inverter current level changes, the efficiency calculation performed by the backlight drive calculator (BDC) 324 (see FIG. 3) accounts for the inverter current level change. The BDC 324 modifies the drive level by the ratio of the normal or reference inverter current to the actual inverter current level. If the boost current level is at 9 mA and the normal current at which efficiencies are determined is 5.5 mA, then the BDC 324 modifies the drive level by 5.5/9.

Figure 6:
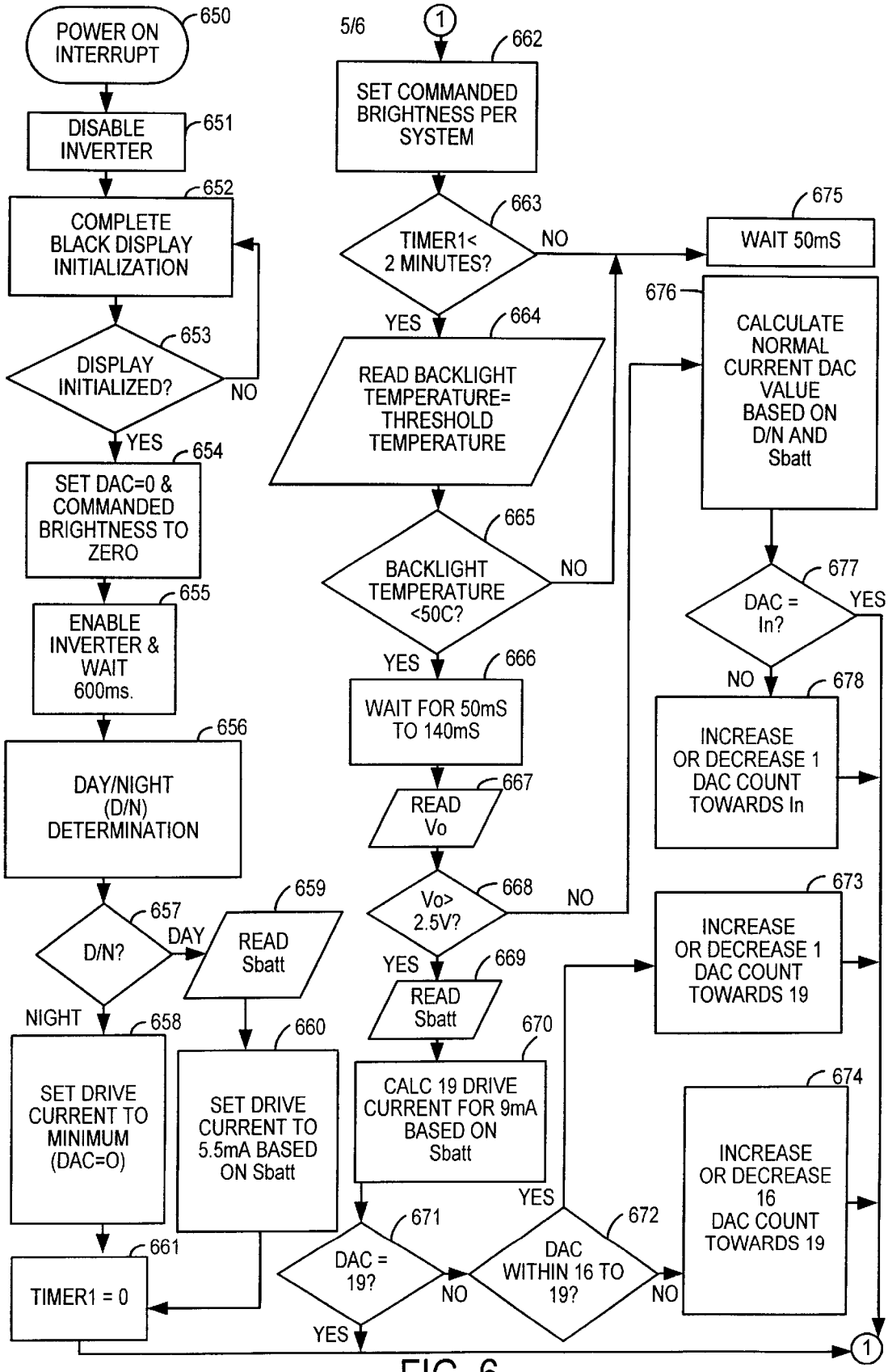
FIG. 6 represents a flowchart of a system for selecting a drive current level for a backlight in a backlight display device according to one embodiment.

FIG. 6 represents a flowchart of a system for selecting a drive current level for a backlight in a backlight display device according to one embodiment. The current control selector 422 or another suitable component of the brightness control system may perform the method. The start occurs when the backlight display device is turned on and detected as a "Power On Interrupt" in 650. The inverter 424 may be disabled until the display is properly initialized. This avoids presenting an objectionable flashing screen to the user. The display initialization for a black display is completed in 652.

Figure 7:
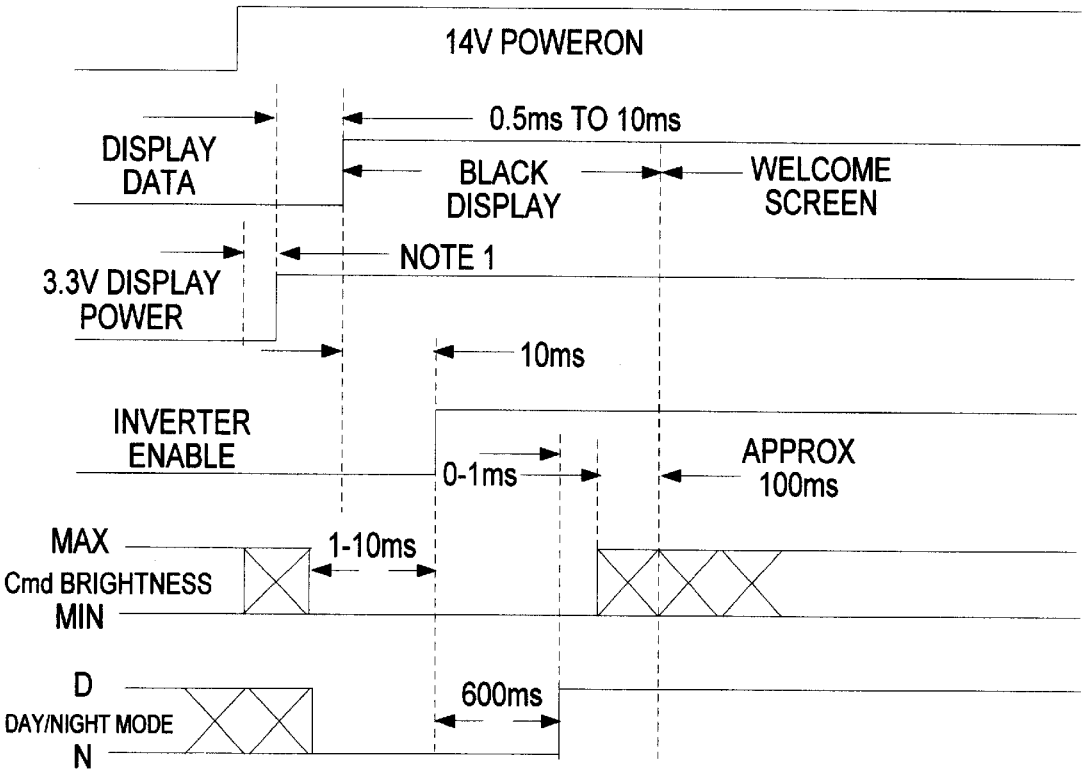
FIG. 7 shows the power-up timing in one embodiment of a brightness control system for a backlight display device.

After the inverter is disabled, the inputs to the display are held in a low state until power is applied to the display. The power may be about 3.3V. In 653, various display signals such as LCD CLOCK, VSYNC, HSYNC, ENABLE, and the like are activated after about 400 us and before about 10 mS. FIG. 7 shows the power-up timing for the display signals, data, and power in one embodiment. This display and inverter power up sequence may reduce or prevent initial display flicker.

The inverter is set in 654 for a night current level and for a commanded or desired brightness level of 0. This is done to present a minimum brightness while the inverter stabilizes. The inverter is enabled in 655 once the display is initialized and the correct inverter inputs have been established. Turning on the inverter lights the display so the user may observe display information. After the inverter is enabled, there is a pause of about 600 ms to allow the inverter to stabilize.

Day or night (DIN) is determined in 657 to ascertain whether the display should be operated in a day or a night mode. The D/N state may be used to set the nominal current for about 5.5 mA for day and about 5.0 mA for night. The Sbatt voltage is detected in 659 to determine the correct the DAC value in 660 to drive the inverter at the 5.5 mA level. If a "Night" condition is determined, the DAC count is set at 0 to drive the inverter at a minimum current level in 658 to establish the minimum inverter current independent of the battery voltage. A timer or counter is set to 0 and started in 661 to determine when a boost current time limit has been exceeded.

The commanded brightness or desired brightness is set in 662 to a suitable level for initial power up. The backlight may start in an automatic mode or may have a manually set mode for start up and may have an initial backlight luminance using power-down fine-tune presets. In one aspect, the start up level provides a display luminance sufficient to be viewed under the ambient lighting condition and to prevent a condition where a user cannot view the display because of a prior nighttime or dim daytime luminance level.

If the time from the when the inverter is enabled in 655 is less than 2 minutes, then the 9 mA "Boost" current may be provided in 663. The backlight temperature is read in 664 to determine if the "Boost" current should be utilized. If the backlight temperature is below a threshold temperature in 665, then turning on the "Boost" current may help obtain the desired luminance. In one aspect, the threshold temperature is about 50° C.

After enabling the inverter, the brightness control system waits or performs other tasks in 666 for approximately 50 mS to 140 mS. The backlight hardware responds to the commanded brightness level and retrieves the Vo voltage value (see FIG. 3). The Vo is read in 667 and compared to the digital Vo value of 193, which is the upper dynamic range value for the inverter. If the Vo is less than digital value 193, then the brightness control feedback is within the dynamic range and is properly controlling the backlight luminance to the commanded level. If however the Vo is greater than digital value 193, the brightness control cannot obtain the brightness level with the current level. At power up, this usually occurs since the backlight has not warmed up to the required temperature for the commanded luminance level. At initial unit power up, if the Vo is greater than 2.5 V or digital value 193, the "Boost" current level of 9 mA is applied to help warm up the backlight and obtain the desired luminance level. The efficiency calculation may adjust the efficiency by a factor of the normal current divided by the.commanded current level. If the commanded current is 9 mA and the normal current is 5.5 A, then the factor is 5.5/9.

To use the 9 mA "Boost" current, Sbatt is detected in 669 in preparation for selecting the correct DAC value. After initial power up, the DAC value for a 9 mA inverter current is calculated in 670 using the Sbatt. The calculated DAC value is compared in 671 to the current DAC value. If the current DAC value is equal to the calculated DAC value, then the process returns to 662. If the current DAC value is not equal to the calculated DAC value, then how fast the DAC count should be modified is determined in 672. If the current DAC value is within 16 to 19 (9 mA value) of the calculated DAC value in 670, the DAC count is increased or decreased by 1 in 673 towards the desired 9 mA value. Otherwise, the DAC count is increased or decreased by 16 counts in 674. This enables the DAC value to more quickly approach the desired current value due to the timing constraints of obtaining the Vo value. Once the 9 mA boost is no longer desired due to exceeding the 2 minute time, 50° C. temperature, or Vo is in the control range, the current is decreased to normal values in 675 and 676.

Before changing the DAC value towards a desired current value, the brightness control system waits 50 mS in 675. This provides a slower change in the current value. The normal current level DAC value is calculated in 676 based on the Sbatt voltage and Day/Night determination. The Sbatt and Day/Night determination may be determined each time due to their dynamic nature. The current DAC value is compared in 677 to the desired normal current, In, value. If the DAC value is equal to In (normal current), then the process continues to 662. Otherwise, the DACD value is adjusted in 678, in which the DAC value is increased by 1 count towards the desired DAC value (In).

In addition to maintaining the correct normal current, the current may be reduced in 678 from the 9 mA Boost to Normal current. If the conditions described above are met to reduce from Boost to Normal current, the DAC count may be slowly decreased the so that the reduction is imperceptible to a user. Together with the 50 ms time constant in 675, the time over which the "Boost" current is reduced to the normal current is about 9 seconds. A feedback control loop is established that is dependent on the Vo and the backlight temperature. If the Vo is capable of providing the commanded brightness, the "Boost" current is no longer required and may be reduced. However, reducing the "Boost" current may cause the feedback loop to drive harder. Therefore by using the aforementioned sequence, the "Boost" current is reduced at a rate sufficient for the control loop to maintain the commanded brightness. If the commanded brightness is low, the "Boost" current may not even be required in which case the Vo is less than 2.5V. Reducing the "Boost" current under cold operational conditions is beneficial towards extending the backlight life.

The brightness control system may be used in systems that have adequate computational power to calculate the backlight drive level as a function of desired brightness and efficiency, such as in electronic devices and automotive applications. In particular, this efficiency approach to backlight may be used in automotive and similar environments that have a wide operational temperature environment and the need for many levels of brightness control, especially if smooth brightness control functions are desired. By using a thermal sensor feedback method to control brightness, overall system costs may be reduced.

Various embodiments of the invention have been described and illustrated. However, the description and illustrations are by way of example only. Many more embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. A backlight display device having a brightness control system, comprising:

a display panel;

a backlight disposed adjacent to the display panel;

a temperature measurement device operatively disposed near the backlight; and control circuitry connected to receive a temperature signal from the temperature measurement device and connected to provide a drive current to the backlight, where the control circuitry determines a backlight efficiency in response to the temperature signal, and where the control circuitry determines the drive current in response to the backlight efficiency and a desired brightness signal.

2. The backlight display device according to claim 1, where the drive current ($V_o$) is determined according to the equation, $V_o$=B/E, where B is the desired brightness signal and E is the backlight efficiency.

3. The backlight display device according to claim 1, where the control circuitry comprises:

an analog to digital converter (ADC) connected to receive the temperature signal from the temperature measurement device;

a backlight efficiency selector connected to receive a digitized temperature signal from the ADC;

a brightness drive calculator connected to receive the backlight efficiency from the backlight efficiency selector, the brightness drive calculator to provide a drive current level in response to the backlight efficiency and the desired brightness signal; and a backlight current driver connected to receive the drive current level from the brightness drive calculator and connected to provide the drive current to the backlight.

4. The backlight display device according to claim 3, where the control circuitry further comprises an over-temperature protector connected to the brightness drive calculator and the backlight driver.

5. The backlight display device according to claim 4, where the over-temperature protector limits the backlight current when the backlight temperature is below the range of about 45° C. through about 70° C.

6. The backlight display device according to claim 5, where the over-temperature protector limits the backlight current to about 10 mA.

7. The backlight display device according to claim 4, where the over-temperature protector limits the backlight current when the backlight temperature is above the range of about 45° C. through about 70° C.

8. The backlight display device according to claim 7, where the over-temperature protector limits the backlight current to about 6 mA.

9. The backlight display device according to claim 3, where the brightness drive calculator comprises a digital to analog converter.

10. The backlight display device according to claim 3, where the drive current level ($V_o$) is determined according to the equation, $V_o$=B/E, where B is the desired brightness signal and E is the backlight efficiency.

11. The backlight display device according to claim 1, where the display panel is an active matrix liquid crystal display.

12. The backlight display device according to claim 1, where the display panel and backlight comprise a backlit display.

13. The backlight display device according to claim 1, where the display panel and backlight comprise a frontlit display.

14. The backlight display device according to claim 1, where the backlight is a cold cathode fluorescent lamp.

15. The backlight display device according to claim 1, where the temperature measurement device comprises a temperature sensitive resistor.

16. The backlight display device according to claim 1, where the temperature measurement device is attached to the backlight.

17. The backlight display device according to claim 1, where the desired brightness signal is provided by at least one of an automatic brightness control system and a manual brightness control system.

18. The backlight display device according to claim 1, where the control circuitry comprises at least one integrated circuit (IC) chip.

19. The backlight display device according to claim 1, where the backlight display device comprises a display of a navigation radio.

20. The backlight display device according to claim 1, where the backlight display device comprises a display of an electronic device.

21. The backlight display device according to claim 20, where the backlight display device is one of a communication device, a personal computer, and a personal organizer.

22. A method for controlling the brightness of a backlight display device, comprising:

(a) providing a desired brightness signal for a backlight;

(b) generating a temperature signal indicative of a temperature of the backlight;

(c) determining a backlight efficiency in response to the temperature signal; and (d) providing a drive current to the backlight in response to the backlight efficiency and the desired brightness signal.

23. The method according to claim 22, where (b) further comprises:

measuring the temperature of the backlight;

generating an analog signal indicative of the temperature; and converting the analog signal into the temperature signal.

24. The method according to claim 23, where a temperature sensitive resistor provides the analog signal.

25. The method according to claim 22, where at least one of an automatic brightness control system and a manual brightness control system provides the desired brightness signal.

26. The method according to claim 22, where the drive current ($V_o$) is determined according to the equation, $V_o$=B/E, where B is the desired brightness signal and E is the backlight efficiency.

27. The method according to claim 22, further comprising:

(e) determining whether it is daytime or nighttime;

(f) where if it is daytime, setting the drive current for the backlight to a preset current level; and (g) where if it is nighttime, setting the drive current for the backlight to a minimum current level.

28. The method according to claim 27, where the preset current level is about 5.5 mA and where the minimum current level is about 5.0 mA.

29. The method according to claim 22, further comprising providing a boost current to the backlight.

30. The method according to claim 29, where the boost current is applied when the backlight has been operating for less than a predetermined time period.

31. The method according to claim 29, where the boost current is applied when the temperature of the backlight is less than a threshold temperature.

32. The method according to claim 29, further comprising reducing the boost current to maintain a commanded brightness when the drive current is within a dynamic range control.

33. The method according to claim 22, further comprising limiting the drive current when the backlight temperature is below about 45° C.

34. The method according to claim 33, where the drive current is limited to about 10 mA.

35. The method according to claim 22, further comprising limiting the drive current when the backlight temperature is above about 70° C.

36. The method according to claim 35, where the drive current is limited to about 6 mA.

* * * * *